US007926525B2

(12) United States Patent
Vaccarella

(10) Patent No.: US 7,926,525 B2
(45) Date of Patent: Apr. 19, 2011

(54) ADJUSTABLE AND ACCESSORIZEABLE CARRYING CASE

(76) Inventor: Kimberlee Vaccarella, Ridgewood, NJ (US)

( * ) Notice: Subject to any disclaimer, the term of this patent is extended or adjusted under 35 U.S.C. 154(b) by 718 days.

(21) Appl. No.: 11/975,257

(22) Filed: Oct. 18, 2007

(65) Prior Publication Data

US 2009/0101254 A1 Apr. 23, 2009

(51) Int. Cl.
*A45C 13/30* (2006.01)
*A45C 13/26* (2006.01)

(52) U.S. Cl. ..... 150/108; 383/15; 383/6; 383/13; 383/26; 383/103; 220/759; 220/772; 220/676; 150/107; 150/104

(58) Field of Classification Search ..... 190/110; 383/15, 6, 103, 105, 13, 26; 220/759, 764, 220/772, 773, 676; 150/107, 108, 104, 109
See application file for complete search history.

(56) References Cited

U.S. PATENT DOCUMENTS

| | | | | | |
|---|---|---|---|---|---|
| 2,797,605 | A * | 7/1957 | Metze, Jr. et al. | ..... | 411/339 |
| 3,115,804 | A * | 12/1963 | Lee | ..... | 411/338 |
| 3,180,385 | A * | 4/1965 | Shigehaur | ..... | 220/760 |
| 4,240,480 | A * | 12/1980 | Strobel | ..... | 383/15 |
| D401,067 | S * | 11/1998 | Hampshire | ..... | D3/309 |
| 6,374,461 | B1 * | 4/2002 | Gober et al. | ..... | 16/444 |
| 7,607,461 | B2 * | 10/2009 | Pace et al. | ..... | 150/105 |

FOREIGN PATENT DOCUMENTS

| | | | |
|---|---|---|---|
| JP | 2003-189921 | * | 7/2003 |
| JP | 2007-151822 A | * | 6/2007 |

* cited by examiner

*Primary Examiner* — Tri M Mai
(74) *Attorney, Agent, or Firm* — Robert P. Michal; Lucas & Mercanti, LLP

(57) ABSTRACT

Handbag or carrying case includes a body defining a retaining compartment for retaining objects and having apertures on opposed sides, and elongate straps each having opposite end regions and at least two apertures, one proximate each end region. Snap fasteners attach the straps to the first and second sides via aligning pairs of apertures, i.e., one apertures on a side of the body and one aperture on the strap. The snap fasteners may be decorative snap fasteners. Use of the snap fasteners provides for variable attachment of the straps to the body and therefore enables each user of the carrying case to position the straps as they desire.

20 Claims, 2 Drawing Sheets

ADJUSTABLE AND ACCESSORIZEABLE CARRYING CASE

FIELD OF THE INVENTION

The present invention relates generally to a handbag or carrying case and more particularly to a handbag or carrying case having straps which are adjustable relative to a body of the carrying case and which handbag or carrying case can be easily accessorized.

Even more particularly, the present invention relates to a handbag or carrying case in which the same structure on a body of the handbag or carrying case enables variable attachment of straps and placement of decorative members.

BACKGROUND OF THE INVENTION

Handbags or carrying cases are common everyday items used by both women and men to carry personal items. Such carrying case are typically used to carry groceries from a supermarket, meals from take-out restaurants, sundries to and from the beach and so on.

A general form of a carrying case includes a body defining a retaining section and one or more straps coupled to the body. When different people use the carrying case, the straps often need to be adjusted for optimum use by that person.

Further, although carrying cases usually are produced in bulk, nowadays people want to personalize their possessions and thus different people may want to personalize a generic carrying case in a different manner, e.g., with different accessories.

It would therefore be desirable to provide a carrying case which enables adjustment of straps and can be personalized with various accessories. As such, each person purchasing the carrying case would be able to position the strap in a desired position relative to the body and also customize or personalize the carrying case with different accessories.

OBJECTS AND SUMMARY OF THE INVENTION

It is an object of the present invention to provide a new and improved handbag or carrying case.

It is another object of the present invention to provide a new and improved handbag or carrying case with straps that can be variably positioned relative to a body of the handbag or carrying case and which can also be personalized with different accessories.

In order to achieve at least one of these objects and possibly others, one embodiment of a handbag or carrying case in accordance with the invention, referred to hereinafter as a carrying case, includes a body defining a retaining compartment for retaining objects and including opposed sides and a plurality of apertures on each of the sides, and a pair of elongate straps each having opposite end regions and at least two apertures, one proximate each end region. Further, the carrying case includes snap fasteners arranged to attach the straps to the sides of the body via aligning pairs of apertures, i.e., one apertures on a side of the body and one aperture on the strap. To this end, the snap fasteners have two parts separable from one another such that the straps are removable from engagement with the body and positionable in different positions relative to the body. This provides for variable attachment of the straps to the body and therefore enables each user of the carrying case to position the straps as they desire.

In one embodiment, the body includes a base section defining a bottom of the compartment and a main body section including an annular portion defining the opposed sides. Apertures are formed only in the main body section and not in the base section. Apertures may be formed in an orderly manner, e.g., in a plurality of substantially straight rows and in a plurality of substantially straight columns, on each side of the annular portion such that each row includes at least two apertures and each column includes at least two apertures. Each row may include any number of apertures, e.g., two to five, while each column may include any number of apertures, e.g., two to four.

While the presence of many apertures on the sides of the main body section enables variable attachment of the straps thereto, additional variability may be provided when the straps includes more than two apertures extending in a row in a longitudinal direction. In this case, the length of the strap between attachment points can be varied by appropriate selection of the apertures on the strap to align with the apertures on the main body section.

Each snap fastener may include a first inner part having a flange arranged to prevent passage thereof through an aperture in the main body section and a second outer part having a flange arranged to prevent passage thereof through an aperture in the strap. The second outer part may be decorative, i.e., include a decoration on its outer side or face which will be visible during use of the carrying case. Since each user can select which decorative snap fastener they want to use to attach the straps to the main body section, the carrying case can be personalized with different accessories.

Such decorative snap fasteners can also be used for a purely ornamental purpose, i.e., inserted through an aperture in the man body section but not through an aperture in the strap. In this case, it emerges that the same apertures which are used to attach the straps to the main body section can also be used to personalize the carrying case and thus serve a dual purpose.

The carrying case described above can be used in a kit which enables easy construction of multiple and different carrying cases. Such a kit would include the carrying case with three or more straps which are different from one another with respect to size, color and/or style. Such straps may also have a different color than the color of the body of the carrying case. Such a kit could also include a plurality of different decorative snap fasteners. As such, many different combinations of decorative snap fasteners and straps could be connected to the body to thereby enable formation of visually distinct carrying cases from the same kit.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
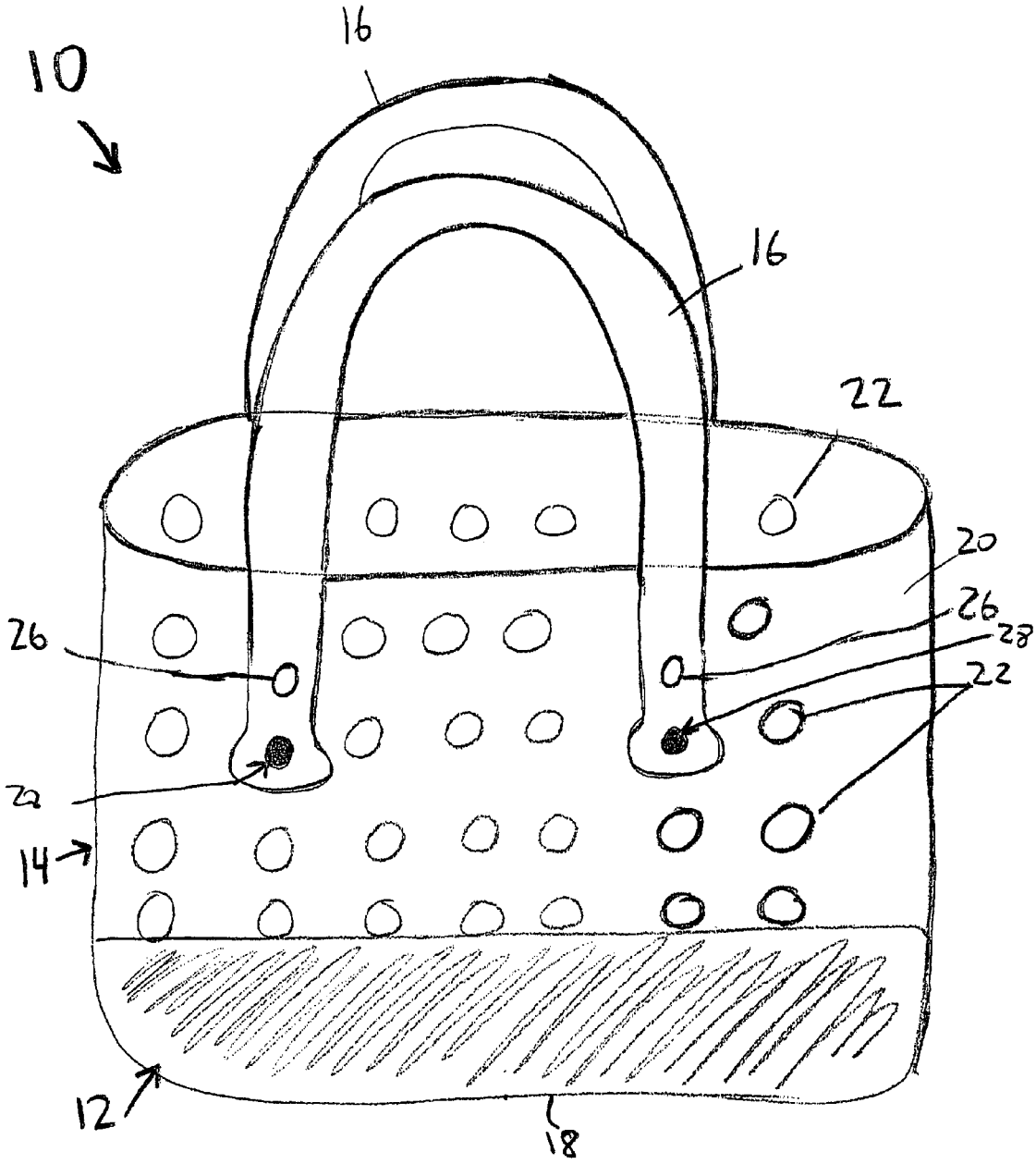
FIG. 1 is a perspective view of a carrying case in accordance with the invention.

Referring the accompanying drawings wherein like reference numerals refer to the same or similar elements, a carrying case in accordance with the invention is shown in FIGS. 1-4 and designated generally as 10 and comprises a base section 12, a main body section 14 and a pair of straps 16.

Base section 12 and main body section 14 may be formed integral and/or monolithic with one another and/or formed as a unitary body, or as separate parts which are attached together. When formed as an integral, monolithic and/or unitary structure, the shape and/or form of the combined base section 12 and main body section 14 may vary and includes, but is not limited to, those currently used for carrying cases, such as a box-shaped carrying case, a sack-type carrying case, a bucket-type carrying case, and a waist-band-type carrying case.

Base section 12 may be made of a solid, non-perforated material which is flexible or rigid. For example, base section 12 may be made from the foam resin "croslite", a type of ethylene vinyl acetate. Otherwise, the base section 12 may be made from a lightweight antimicrobial material.

As shown, base section 12 is made of a slightly rigid material to provide the lower portion of the carrying case 10 with a rigid form. The lower surface 18 of the base section 12 can be formed with an imprint or form similar to a sole of a clog. Additionally or alternatively, the edges of the base section 12 can be provided with sole grips.

Main body section 14 includes an annular portion 20 having a plurality of apertures 22 therein. Apertures 22 may be arranged in substantially straight rows and columns as shown, with any number of columns, e.g., from two to ten and possibly at least four, and any number of rows, e.g., from two to ten and possibly at least four, or in a random arrangement. As shown, each side of the annular portion 20 includes four rows of seven apertures 22 each to thereby form seven columns of apertures.

Apertures 22 may be provided along the entire surface of the annular portion 20 or along only one or more discrete, localized portions thereof. The size and shape of the apertures 22 can vary as desired, with all apertures 22 possibly having the same or a substantially similar size and/or shape. A carrying case in accordance with the invention may therefore include any number of apertures, arranged at any locations whether in an orderly or random arrangement, having any desired size or sizes, and having any desired shape or shapes.

Figure 2:
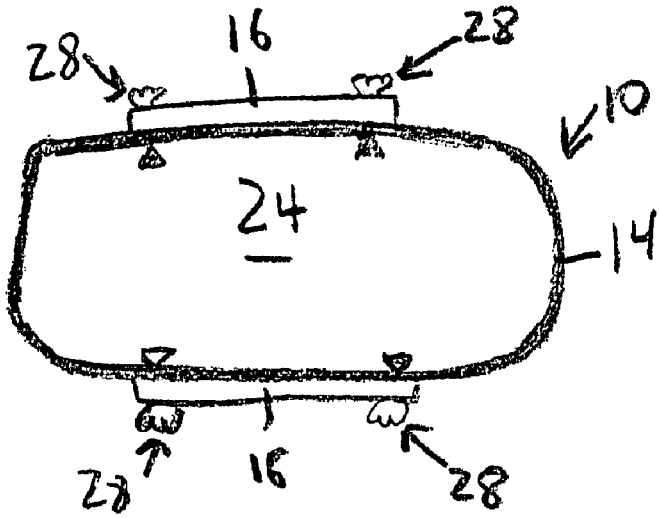
FIG. 2 is a top view of the carrying case shown in FIG. 1.
Figure 3:
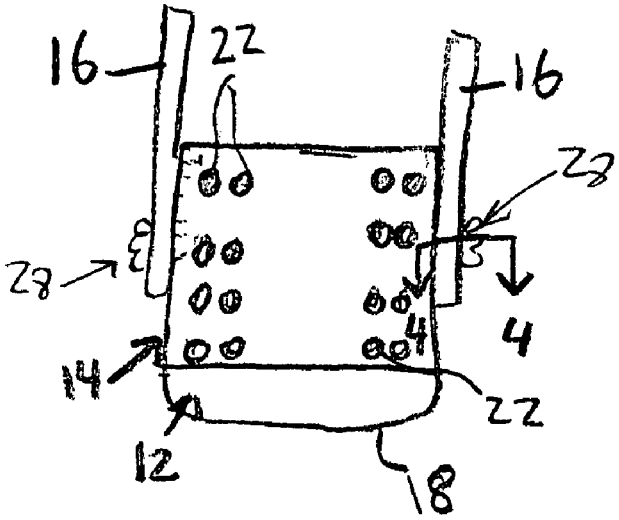
FIG. 3 is a side view of the carrying case shown in FIG. 1.

Apertures 22 may be formed by perforating an initially solid strip of material, or a strip of material could be formed to initially include apertures, and which strip is then manipulated into the annular shape shown clearly in FIG. 2.

Annular portion 20 may be made from a flexible or rigid material. For example, annular portion 20 may be made from the foam resin "croslite", a type of ethylene vinyl acetate. Otherwise, the annular portion 20 may be made from a lightweight antimicrobial material.

There are virtually no limitations on the placement of apertures 22 on the annular portion 20. One minor limitation is that the annular portion 20 should provide a sufficiently sturdy connection between the location at which the straps 16 are attached and the base section 12 to enable a retaining compartment 24 defined by the base section 12 and main body section 14 to usefully retain objects. The retaining compartment 24 is not limited to being formed by the base section 12 and main body section 14 and may be formed by other sections or constructions. Generally, carrying case 10 in accordance with the invention includes a body or any other structure which defines a retaining compartment having opposed sides connected to one another, with apertures on each side.

Each strap 16 includes apertures 26 and is attached to the annular portion 20 of the main body section 14 via snap fasteners 28 which snap together through an aligning pair of apertures 22, 26, i.e., an aperture 26 on the strap 16 is aligned with an aperture 22 on the annular portion 20 and a snap fastener 28 is snap together therethrough. Straps 16 are attached on opposed or opposite sides of the annular portion 20 and preferably in alignment with one another so that the person using the carrying case 10 can easily grasp both straps 16.

Each strap 16 may include a single aperture 26 proximate each end region, i.e., only two apertures, or more than two apertures 26 extending in a row in a longitudinal direction of the strap 16 (as shown in FIG. 1). In this case, at least some of the apertures 26 are preferably situated proximate the opposite end regions of the straps 16.

Straps 16 may be made from a flexible or rigid material. For example, straps 16 may be made from the foam resin "croslite", a type of ethylene vinyl acetate. Otherwise, the straps 16 may be made from a lightweight antimicrobial material.

Figure 4:
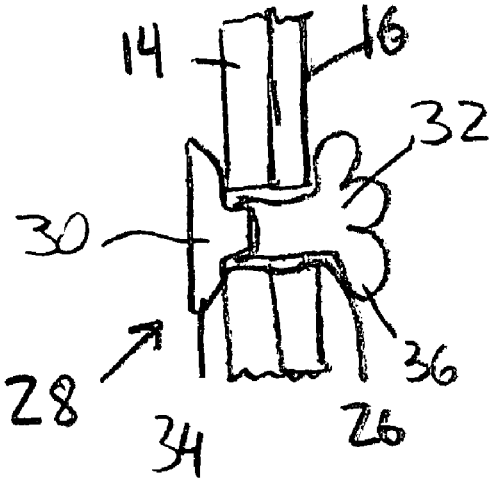
FIG. 4 is a cross-sectional view taken along the line 4-4 of FIG. 3.

Each snap fastener 28 has two parts 30, 32 with part 30 being an inner part which has a flange 34 alongside the inner surface of the annular portion 20 and part 32 having a flange 36 alongside the outer surface of a strap 16 (see FIG. 4). Flange 34 has a size and shape which prevents it from passing through an aperture 22 in the annular portion 20 while flange 36 has a size and shape which prevents it from passing through an aperture 26 in the strap 16.

In view of the placement of multiple apertures 22 in the annular portion 20 of the main body section 14, and also possibly when more than two apertures 26 are arranged in the straps 16, and the use of snap fasteners 28 to attach the straps 16 to the annular portion 20 of the main body section 14, attachment of the straps 16 to the main body section 14 can be varied as desired to provide an optimum fit and/or desired appearance for the user of the carrying case 10. That is, the user can select apertures 22 of the annular portion 20 of the main body section 14 to align with the apertures 26 on the strap 16 and then snap the snap fasteners 28 through the aligning pairs of apertures 22, 26. If the strap 16 is not in a desired position relative to the main body section 14 or subsequently it is desired to change the relative position between the strap 16 and the main body section 14, the snap fastener 28 is opened and the strap 16 is moved until apertures 26 therein align with one or more different apertures 22 in the main body section 14.

Accordingly, by providing multiple apertures 22 in the annular portion 20 of the main body section 14, it becomes possible to enable variable relative positioning of the straps 16 on the main body section 14. The variations in the positioning of the straps 16 relative to the main body section 14 can further be increased when the straps 16 themselves include more than two apertures 26 and/or have an adjustable length.

Snap fasteners 28 may be substituted for by any type of two-part fastener. Preferably, to maintain the adjustability feature of the straps 16, the snap fasteners 28 should be of a type wherein one part is detachable from the other.

The size of the carrying case 10 may vary as desired. In one embodiment, the carrying case 10 has a length of about 13.5 inches, a height of about 9.5 inches and a depth of about 6 inches. The base section 12 is about 8.5 inches long. In another embodiment, the carrying case 10 has a length of about 17 inches, a height of about 13 inches and a depth of about 6.5 inches. The base section 12 is about 11.5 inches long. In yet another embodiment, the carrying case 10 has a length of about 22.5 inches, a height of about 17 inches and a depth of about 9.5 inches. The base section 12 is about 14.5 inches long. In yet another embodiment, the carrying case 10 has a length of about 26 inches, a height of about 17.5 inches and a depth of about 10 inches. The base section 12 is about 17 inches long. In any of these embodiments, the height of the base section 12 and the height of the main body section 14 may be selected as desired.

The color of the carrying case 10 may also vary as desired. In some embodiments, the base section 12 and main body section 14 have the same color while the straps 16 have a different color. However, the base section 12 and main body section 14 may be different colors, different from one another and optionally also different than the color of the straps 16. The straps 16 themselves may have different colors.

Furthermore, a carrying case 10 may be sold in a kit with multiple straps 16, in different colors, sizes (lengths) and/or styles (overall design). Thus, an exemplifying kit including a carrying case 10 in accordance with the invention would include not only a body forming an object-retaining compartment such as described above but would also include a minimum of three straps, at least one of which is different than the other two. This allows for variations in the selection of two of these three straps for attachment to the carrying case. Another embodiment of a kit could include a plurality of pairs of identical straps, e.g., two blue straps, two red straps and two green straps, so that each pair could be used independently and different carrying cases formed. Straps could also be sold separately from the kits to enable users to subsequently purchase additional straps. Also, different bodies of the carrying case, i.e., the base section 12 and the main body section 14, can be sold separately so that users can separately purchase one or more bodies and straps and create whatever combinations of bodies and straps they want.

In one embodiment, decorative snap fasteners known as JIBBITZ™ may be used in a similar manner as they are used in connection with footwear sold under the tradename CROCS™ by Crocs, Inc., with the decorative part of the snap fastener facing outward. In one embodiment, the apertures 22, 26 all have a common or substantially similar size which enable such decorative snap fasteners to be used. Moreover, the straps 16 themselves may be the ankle straps as used on the footwear sold under the tradename CROCS™. In one particular embodiment, large JIBBITZ™ are used and apertures 22 and/or apertures 26 dimensioned accordingly.

Using such JIBBITZ™, or other decorative snap fasteners, whether functionally to attach the straps 16 to the main body section 14 or simply as decorations on the main body section 14 and/or straps 16, a user can accessorize and personalize their carrying case 10 in whatever manner they see fit, limited only by the availability of decorative snap fasteners or materials for creating such decorative snap fasteners. Use of such decorative snap fasteners does not damage the carrying case 10 because they pass through apertures 22 in the main body section 14 and/or apertures 26 in the straps 16.

Moreover, it can be seen that the same structure which enables variable attachment of straps 16, i.e., apertures 22 cooperating with apertures 26 on the straps 16, also enables placement of decorative snap fasteners 28. The presence of unused apertures 22 on the main body section 14 and apertures 26 on the straps 16 therefore enables attachment of purely decorative snap fasteners 28.

In some embodiments, all of the elements of the carrying case 10 are made of foam material, such as "croslite" which is the same material as used in the footwear sold under the tradename CROCS™, while in others, all of the elements are made of leather. It should be understood that the selection of the materials of the components of the carrying case 10 is not limited to foam material or leather and may be any single material or combination of materials.

While particular embodiments of the invention has been shown and described, it will be obvious to those skilled in the art that changes and modifications may be made without departing from the invention in its broader aspects, and, therefore, the aim of this application is to cover all such changes and modifications as fall within the true spirit and scope of the invention.

The invention claimed is:

1. A carrying case, comprising;

a body defining a retaining compartment for retaining objects, said body including opposed sides, first and second apertures on each of said opposed sides and a plurality of additional apertures on each of said opposed sides;

a pair of elongate straps, each of said straps having opposite first and second end regions and having a first state in which said strap is attached to said body at both first and second end regions and a second state in which said first and second end regions of said strap are detached from said body, each of said straps comprising:

at least first, second and third apertures, said first aperture being proximate said first end of a respective one of said straps, said second aperture being proximate said second end of the respective one of said straps, and said third aperture being arranged between said first and second apertures; and snap fasteners arranged to removably attach each of said straps to a respective one of said opposed sides via aligning pairs of one of said apertures on the respective one of said opposed sides of said body and one of said apertures on said strap to thereby provide said strap with the first state, said snap fasteners having two parts separable from one another such that said straps are removable from engagement with said body to thereby provide said strap with the second state and positionable in different positions relative to said body to thereby provide a plurality of different configurations in which each of said straps is attached to the respective one of said opposed sides of said body, whereby each of said straps is attachable to the respective one of said opposed sides of said body via any two of said first aperture, said second aperture and one of said additional apertures on said opposed side and any two of said first, second and third apertures on said strap.

2. The carrying case of claim 1, wherein said body comprises a base section defining a bottom of said compartment and a main body section defining said opposed sides, said apertures on said opposed sides being formed only in said main body section and not in said base section.

3. The carrying case of claim 2, wherein said main body section includes an annular portion defining said opposed sides, said apertures being formed in a plurality of substantially straight rows and in a plurality of substantially straight columns on each of said opposed sides such that each of said rows includes at least two apertures and each of said columns includes at least two apertures.

4. The carrying case of claim 3, wherein each of said rows includes at least four apertures and each of said columns includes at least four apertures.

5. The carrying case of claim 3, wherein all of said apertures have a common size.

6. The carrying case of claim 2, wherein said base section and said main body section are integral and/or monolithic with one another and/or formed as a unitary body.

7. The carrying case of claim 1, wherein said body and said straps are formed from ethylene vinyl acetate or leather.

8. The carrying case of claim 1, wherein said first, second and third apertures on each of said straps extend in a row in a longitudinal direction of said strap.

9. The carrying case of claim 1, wherein each of said snap fasteners has a first inner part having a flange arranged to prevent passage of said first inner part through an aperture in said body and a second outer part having a flange arranged to prevent passage of said second outer part through an aperture in said strap.

10. The carrying case of claim 9, wherein said second outer part is decorative.

11. A carrying case, comprising;

a base section;

a main body section defining an object-retaining compartment with said base section, said main body section having an annular portion defining opposed sides, first and second similarly-sized apertures formed only in said opposed sides of said main body section and not in said base section and a plurality of additional similarly-sized apertures formed only in said opposed sides of said main body section and not in said base section, said apertures being formed in a plurality of substantially straight rows and in a plurality of substantially straight columns on each of said opposed sides such that each of said rows includes at least two apertures and each of said columns includes at least two apertures;

a pair of elongate straps, each of said straps having opposite first and second end regions and having a first state in which said strap is attached to said body at both first and second end regions and a second state in which said first and second end regions of said strap are detached from said body, each of said straps comprising:

at least first, second and third apertures, regions said first aperture being proximate said first end of a respective one of said straps, said second aperture being proximate said second end of the respective one of said straps, and said third aperture being arranged between said first and second apertures; and snap fasteners arranged to removably attach each of said straps to a respective one of said first and second sides via aligning pairs of one of said apertures on the respective one of said opposed sides of said main body section and one of said apertures on said strap to thereby provide said strap with the first state, each of said snap fasteners having a first inner part having a flange arranged to prevent passage of said first inner part through an aperture in said annular portion of said main body section and a second outer, decorative part having a flange arranged to prevent passage of said second outer part through an aperture in said strap, said first inner and second outer parts being separable from one another such that said straps are removable from engagement with said main body section to thereby provide said strap with the second state and positionable in different positions relative to said main body section to thereby provide a plurality of different configurations in which each of said straps is attached to the respective one of said opposed sides of said main body section, whereby each of said straps is attachable to the respective one of said opposed sides of said main body section via any two of said first aperture, said second aperture and one of said additional apertures on said opposed side and any two of said first, second and third apertures on said strap.

12. A kit which enables easy construction of multiple and different carrying cases, comprising;

a body defining a retaining compartment for retaining objects, said body including opposed sides, first and second apertures on each of said opposed sides and a plurality of additional apertures on each of said opposed sides;

at least three elongate straps, each of said straps having opposite first and second end regions and having a first state in which said strap is attached to said body at both first and second end regions and a second state in which said first and second end regions of said strap are detached from said body, each of said straps comprising:

at least first, second and third apertures, said first aperture being proximate said first end of a respective one of said straps, said second aperture being proximate said second end of the respective one of said straps, and said third aperture being arranged between said first and second apertures; and snap fasteners arranged to removably attach any two of said straps each to a respective one of said opposed sides via aligning pairs of one of said apertures on the respective one of said opposed sides of said body and one of said apertures on said strap to thereby provide said strap with the first state, said snap fasteners having two parts separable from one another such that said straps are removable from engagement with said body to thereby provide said strap with the second state and positionable in different positions relative to said body to thereby provide a plurality of different configurations in which each of said straps is attached to the respective one of said opposed sides of said body, whereby each of said straps is attachable to the respective one of said opposed sides of said body via any two of said first aperture, said second aperture and one of said additional apertures on said opposed side and any two of said first, second and third apertures on said strap.

13. The kit of claim 12, wherein at least one of said at least three straps is different from the others of said three straps with respect to size, color and/or style.

14. The kit of claim 12, wherein said at least three straps comprises a plurality of pairs of identical straps.

15. The kit of claim 12, wherein said body comprises a base section defining a bottom of said compartment and a main body section defining said opposed sides, said apertures on said opposed sides being formed only in said main body section and not in said base section.

16. The kit of claim 15, wherein said main body section includes an annular portion defining said opposed sides, said apertures being formed in a plurality of substantially straight rows and in a plurality of substantially straight columns on each of said first and second sides such that each of said rows includes at least two apertures and each of said columns includes at least two apertures.

17. The kit of claim 12, wherein said body and said at least three straps are formed from ethylene vinyl acetate or leather.

18. The kit of claim 12, wherein each said first, second and third apertures on each of said straps extend in a row in a longitudinal direction of said strap.

19. The kit of claim 12, wherein each of said snap fasteners has a first inner part having a flange arranged to prevent passage of said first inner part through an aperture in said body and a second outer part having a flange arranged to prevent passage of said second outer part through an aperture in said strap.

20. The kit of claim 12, wherein said second outer part is decorative.

* * * * *